US011413200B2

(12) United States Patent
Chu

(10) Patent No.: US 11,413,200 B2
(45) Date of Patent: Aug. 16, 2022

(54) SLIDABLE LIFTING SEAT APPARATUS AND METHOD TO ASSIST STANDING UP

(71) Applicant: Yen Ching Chu, Cupertino, CA (US)

(72) Inventor: Yen Ching Chu, Cupertino, CA (US)

( * ) Notice: Subject to any disclaimer, the term of this patent is extended or adjusted under 35 U.S.C. 154(b) by 0 days.

(21) Appl. No.: 16/776,346

(22) Filed: Jan. 29, 2020

(65) Prior Publication Data

US 2020/0237593 A1 Jul. 30, 2020

Related U.S. Application Data

(63) Continuation-in-part of application No. 16/776,111, filed on Jan. 29, 2020, now abandoned.

(51) Int. Cl.

| | |
|---|---|
| ***A61G 5/14*** | (2006.01) |
| ***A47C 7/56*** | (2006.01) |
| ***A61G 7/10*** | (2006.01) |

(52) U.S. Cl.

CPC ..... *A61G 5/14* (2013.01); *A47C 7/566* (2013.01); *A61G 7/1034* (2013.01); *A61G 7/1059* (2013.01)

(58) Field of Classification Search

CPC ..... A61G 5/14; A61G 7/1034; A61G 7/1059; A47C 7/566

See application file for complete search history.

(56) References Cited

U.S. PATENT DOCUMENTS

| | | | | | |
|---|---|---|---|---|---|
| 3,158,398 | A * | 11/1964 | Stryker | A61G 5/14 | 297/333 |
| 5,048,893 | A * | 9/1991 | Cowan | A47C 1/023 | 297/329 |
| 5,082,327 | A * | 1/1992 | Crisp | A61G 5/14 | 297/313 |
| 5,116,100 | A * | 5/1992 | Iversen | A61G 5/14 | 297/257 |
| 5,333,931 | A * | 8/1994 | Weddendorf | A61G 5/14 | 297/330 |
| 5,898,953 | A * | 5/1999 | Paxon | A61G 5/14 | 4/248 |
| 6,637,818 | B2 * | 10/2003 | Williams | A61G 5/14 | 297/330 |
| 6,702,383 | B2 * | 3/2004 | Newman | A61G 5/14 | 297/313 |
| 7,334,842 | B1 * | 2/2008 | Wu | A47C 1/023 | 297/313 |
| 7,380,881 | B2 * | 6/2008 | Freed | A47C 1/023 | 297/317 |
| 10,449,100 | B2 * | 10/2019 | Hector | A61G 5/14 | |
| 2020/0237592 | A1 * | 7/2020 | Chu | A61G 5/14 | |

* cited by examiner

*Primary Examiner* — Philip F Gabler
(74) *Attorney, Agent, or Firm* — WPAT Law, P.C.; Anthony King

(57) ABSTRACT

Methods and apparatuses are disclosed to help the elderly or physically impaired individual standing up from a chair, a bench, a wheel chair, a toilet seat, a commode, a rollator seat, a walker seat, or a car seat. The disclosed apparatus to generate lifting thrust for individual to stand up from a chair has a base, a slidable seat pivoted mounted on the base and a lifting spring to reserve the energy on sitting down and release the saved energy on standing up.

4 Claims, 10 Drawing Sheets

SLIDABLE LIFTING SEAT APPARATUS AND METHOD TO ASSIST STANDING UP

CROSS-REFERENCE TO RELATED APPLICATIONS

This application claims priority to, and is a Continuation-In-Part Patent Application of U.S. patent application Ser. No. 16/776,111, filed on Jan. 29, 2020, now pending, which claims priority from Taiwan Patent Application No. 108201378, filed on Jan. 29, 2019, which was issued on May 21, 2019 as Taiwan Utility Model Patent No. M578120, all of which are hereby incorporated by reference in their entireties.

Although incorporated by reference in its entirety, no arguments or disclaimers made in the parent application apply to this divisional application. Any disclaimer that may have occurred during the prosecution of the above-referenced application(s) is hereby expressly rescinded. Consequently, the Patent Office is asked to review the new set of claims in view of all of the prior art of record and any search that the Office deems appropriate.

FIELD OF THE DISCLOSURE

The present disclosed invention is related to chairs or seats for assisting elderly or physically impaired individuals, and more particularly to methods and apparatuses for helping weak muscle elderly or physically impaired individuals to stand up and sit down by themselves.

BACKGROUND OF THE DISCLOSURE

The aging of population is a worldwide social problem. With the growth of the aged, the musculoskeletal ability decreases. Many elderly people or people with physical disabilities can not effectively control the suspension of the trunk required to perform standing up or sitting down. Many studies have confirmed that the body transfer movement from sitting to standing or from standing to sitting is a high-risk movement for the elderly or the disabled individual. Therefore, the elderly or the physically disabled individual often needs external objects to assist standing-up and to prevent from "falling" to the seat in the process of sitting-down.

In the prior arts, many lifting-seats have disclosed to provide additional lifting force standing-up from the chair. These lifting-seat devices can be broadly categorized into two categories. The first type uses spring, pneumatics or counterweight to store the weight of the individual sitting on the seat as a mechanical pre-load. As the individual stands up, the stored mechanical pre-load is released to provide an auxiliary lift to assist in the transfer from sitting to standing. The second type uses an electric motor or external power source to provide the energy required to push the user performing sit-to-stand transfer. The Stryker U.S. Pat. No. 3,158,398, Burke U.S. Pat. No. 3,479,087, Whiteford U.S. Pat. No. 4,688,851, Crisp U.S. Pat. No. 5,082,327, Christian U.S. Pat. No. 10,327,970 B2 are the first type of devices with the lifting force generated by the saved compressed energy from the sitting trunk weight on a compressed spring, compressed air cylinder, or elevated weight. According to the laws of physics, the saved compressed energy cannot be greater than the sitting trunk weight. The saved compressed energy may off-load part of the required energy to raise the trunk on standing up action. However, the actual effective lifting assistance is limited. The Poncy et al. U.S. Pat. No. 4,690,457, Jones U.S. Pat. No. 4,852,849, Weddendorf U.S. Pat. No. 5,333,931, Palmer U.S. Pat. No. 7,594,698 B1, Yu U.S. Pat. No. 8,740,304 B2, Armstrong U.S. Pat. No. 10,219,659 B2 are the second type of devices that generate lifting force by external power sources such as: an electric motor or an energy reservoir engaging a lifting actuator. The external power provides up lifting force to push trunk to standing position. However, it is expensive, bulky and not portable.

Many studies divide the sit-to-stand transfer movements into three phases FIG. 9. The first phase is to lean trunk forward and bend knees to pre-load muscle energy for standing up. The leaning trunk and flexion knees can shift the center of trunk gravity toward to the lifting point on foot, FIG. 10. The shorter distance between the center of trunk gravity and the lifting point on foot, the less energy is required to raise the trunk on the following phase. It is critical to reduce this distance on the first phase to assure adequate muscle power raising the buttocks on the second phases of sit-to-stand transfer movements. The second phase is to lift off the buttocks and to keep the trunk suspended from and above the seat by starting the knee and trunk extension. The muscle power is required to raise the buttocks up and balance the trunk in air above the seat depends on the performance on shortening the distance between the center of trunk gravity and the lifting point on foot in the first phase. The third phase is to transfer upper body vertical to the floor and place the center of trunk gravity over the foot.

Studies show the elderly takes more time in executing sit-to-stand transfer and bends less on trunk leaning and flexion knees as the result of weak musculoskeletal capacity. Not able to move the center of trunk gravity close to the lifting point on foot on the first phase requires extra musculoskeletal capacity to lift off the buttocks from the chair and to keep the trunk suspended and balanced in air on the second phase. Lack of control on lifting and balancing the suspended trunk on the second phase of the sit-to-stand transfer increases the chances of falling. Many studies found elderly or physically impaired individual could fall to the seat on stand-to-sit transfer as the individual could not lower the suspending trunk down to the chair under control. The weak musculoskeletal capacity fails to control the suspended trunk on stand-to-sit transfer is the major cause for elderly or physically impaired individual falling from sitting down.

SUMMARY OF THE DISCLOSURE

Study compared elderly with young people on stand-to-sit and sit-to-stand transfer, finds elderly and physically impaired individuals are not only slower in leaning forward and bending knees movements speed, but also less in leaning forward and bending knees movements amount. The less movement of leaning trunk and bending knees increase the suspending weight torque of the trunk (FIG. 10) and demand more muscle power to control the suspending trunk on sitting-down and standing-up.

The present invention provides apparatus and method to use less muscle power on standing up from sitting. The embodiment of the present disclosure provides a slidable seat apparatus which comprises a slidable top-seat and a fixed-seat which can be part of the chair structure. The top-seat is the slidable portion of the slidable seat and the fixed-seat is the fixed portion of the slidable seat. A sliding means is located between the top-seat and fixed-seat of the slidable seat to reduce the sliding friction between the top-seat and fixed-seat of the slidable seat. On performing the sit-to-stand transfer movements, the forward shifted seat eases the effort on shifting forward the trunk and bending backward the knees and reduces the suspending weight torque which is a moment of force, is the sitting trunk weight times the distance between the center of the sitting trunk gravity and the standing point on foot, FIG. 10. The slidable seat assists standing up by reducing the muscle force required to stand up by means of minimizing the suspending weight torque required to overcome on standing up.

In addition, the present invention provides apparatus and method to generate lifting thrust to assist the individual standing up from sitting. The embodiment of the present disclosure provides a slidable lifting seat apparatus which comprises a slidable seat pivoted connected to a seat base on the front end of the slidable seat. The seat base supports the sitting trunk weight, connects to the chair or is part of the chair structure. A lifting spring is located between the slidable seat and seat base, in close to the front end of the slidable seat location. The lifting spring can be compressed or loaded upon a load such as the body weight is placed on the top of the slidable seat.

The body weight torque is a moment of force, is the sitting body weight times the distance between the center of body gravity and the lifting spring shaft. The spring expanding torque is a moment force, is the expanding force on the compressed spring times the distance between the position of the top spring arm pressing the underside of the slidable seat and the lifting spring shaft. In case of the body weight torque is greater than the spring expanding torque, the slidable seat is pivoted closed down to the rear end of the seat base or to the lowered position. In case of absence of the body weight torque, the lifting spring is relaxed, expanded and the slidable seat is pivoted opened from rear end of the seat base or to the raised position.

The slidable seat comprises a slidable top-seat and a fixed-seat. The fixed-seat of the sliding seat carries the sitting trunk weight load and can be part of the chair structure. A sliding means is located between the top-seat and fixed-seat of the slidable seat to reduce the sliding friction between the top-seat and fixed-seat of the slidable seat. On performing the sit-to-stand transfer movements, the forward shifted top-seat of the slidable seat reduces the body weight torque by shifting the trunk gravity center forward to the lifting spring shaft, and makes the unchanged spring expanding torque greater than the reduced body weight torque. The surplus spring expanding torque on the compressed lifting spring pushes the sitting body up and assists the individual standing up. This is a simple and cost-effective improvement to the first type of spring-assist devices to achieve the lifting thrust performance of the second type.

The method to assist individual standing up from a chair includes the steps of sitting on a slidable seat on a chair, sliding forward the top-seat of the slidable seat to minimize the suspending weight torque, standing up from the forward slid seat with minimum muscle force. The method to generate up lifting thrust includes the steps of sitting on a slidable lifting seat to compress and pre-load the lifting spring, continuously shifting forward the top-seat of the slidable lifting seat to reduce the body weight torque to less than the spring expanding torque, generating the up lifting thrust from the pre-loaded comprised lifting spring and pushing buttocks up to stand up.

DESCRIPTION OF THE PREFERRED EMBODIMENTS

In order to make the objects, technical solutions and advantages of the present invention more comprehensible, the present invention will be further described in detail below with reference to the accompanying drawings. For the convenience of the description, it should not be construed as limiting the novel embodiments of the present invention, which will not be further described in the following embodiments.

Figure 1:
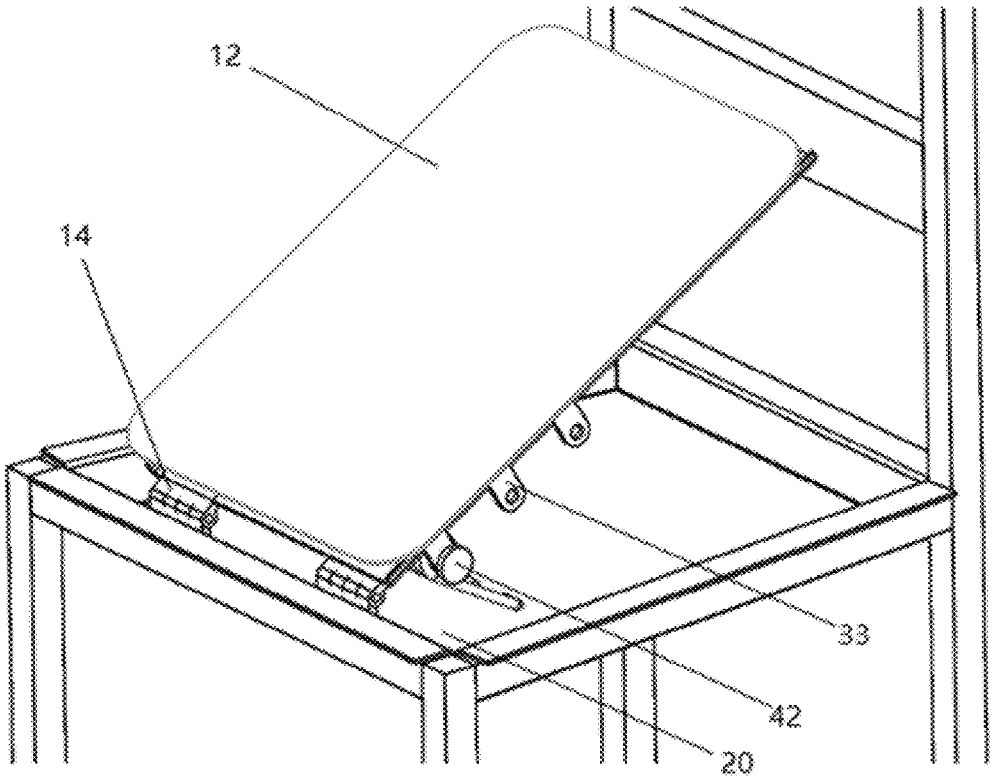
FIG. 1 illustrates a slidable lifting chair not occupied on raised open position.
Figure 2:
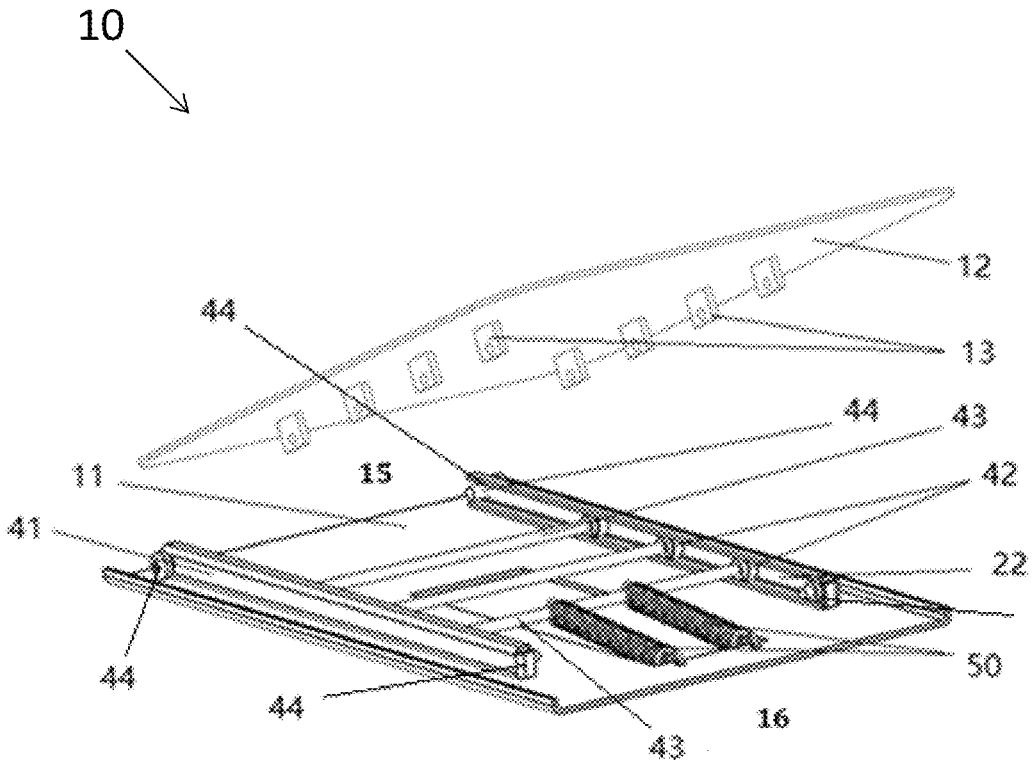
FIG. 2 is the explosive view of a slidable seat in accordance to the embodiment of the present disclosure, the rollers are in the U-channel.
Figure 4:
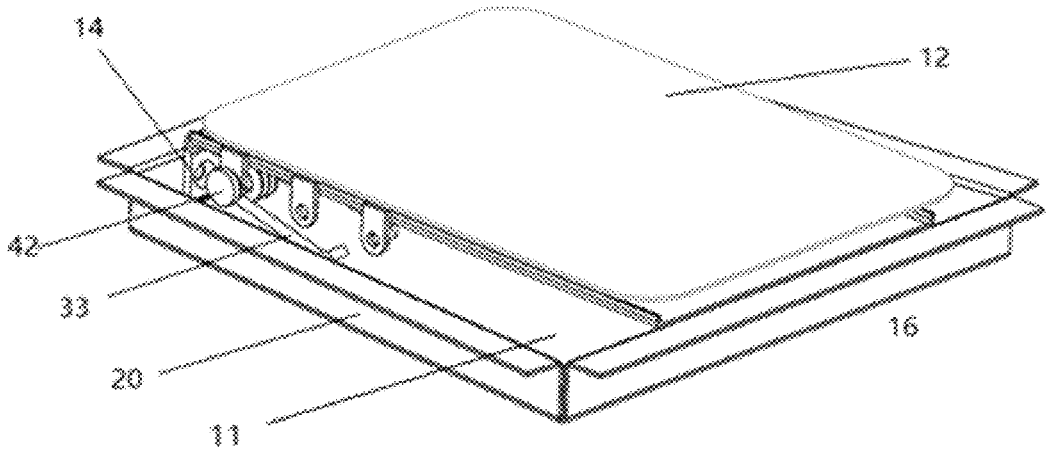
FIG. 4 illustrates the slidable lifting seat on re-tracked and on lowered closed position.
Figure 5:
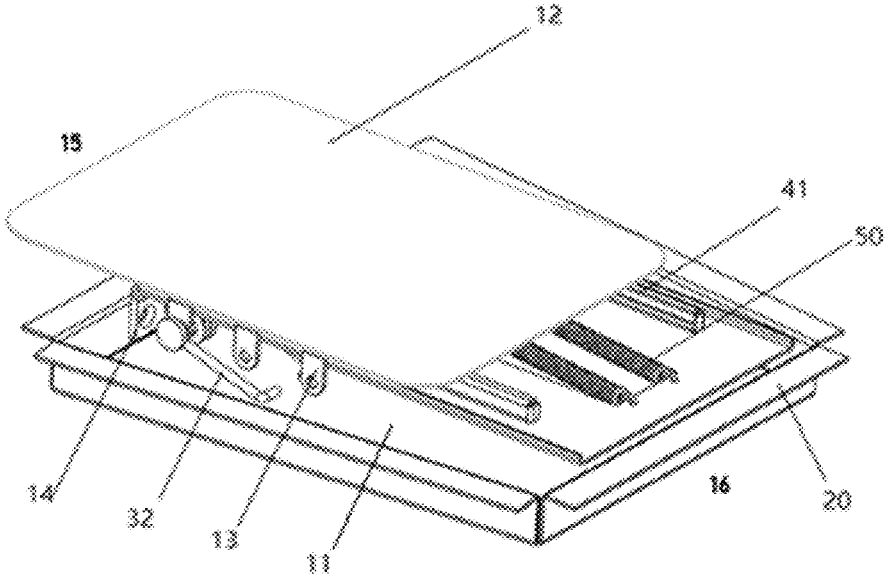
FIG. 5 illustrates the slidable lifting seat on forward slid position.

In FIG. 1 illustrates a slidable lifting seat on a regular chair as one of many applications this disclosed invention can be integrated into a seat cushion, a toilet seat, a bench seat, a commode, a wheel chair, a rollator seat, or a walker seat, sofa chair, a car seat, helping individuals standing up from sitting. As shown in FIG. 2, FIG. 4, and FIG. 5 the disclosed slidable seat 10 apparatus comprises a top-seat 12 and a fixed-seat 11. The top-seat 12 is capable to move the sitting trunk forward and backward linearly on the fixed-seat 11 on directions of the front end 15 and rear end 16 of the slidable seat 10. The fixed-seat 11 is capable to carry the trunk weight and can be part of chair structure.

Figure 6:
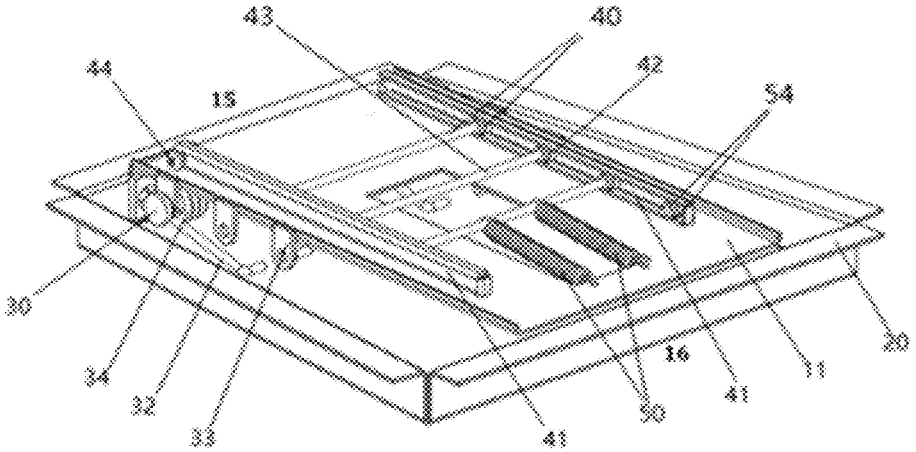
FIG. 6 illustrates the sliding means and re-track spring according to the embodiment of the present disclosure.
Figure 8:
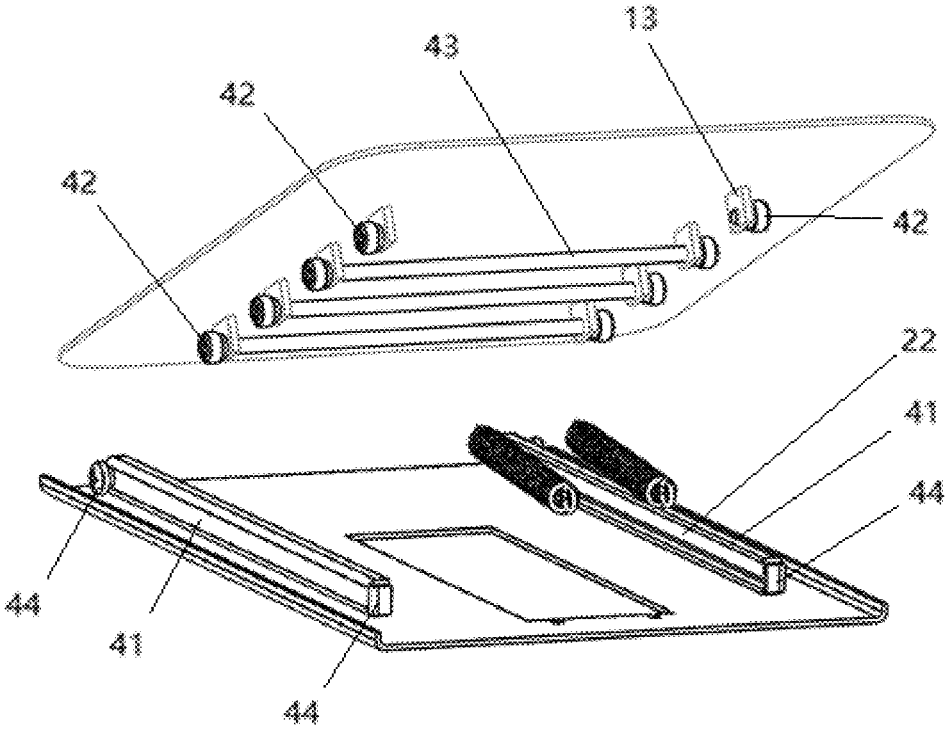
FIG. 8 illustrate the long and short sliding means according to the embodiment of the present disclosure.

In addition, as shown in FIG. 6 and FIG. 8, a sliding means comprises a slidable portion and a fixed portion. The slidable portion of the sliding means comprises multiple long roller assemblies 40, a pair of short roller assemblies 54, and multiple roller shaft brackets 13. The roller shaft bracket 13 is the structure parts connecting the long or short roller assembly and the top-seat 12. The long roller assembly 40 comprises a long roller shaft 43 and two rollers 42, the long roller shaft 43 is suspended fixed on a pair of roller shaft brackets 13, a roller 42 is mounted on each end of the long roller shaft 43 and capable to spin on the roller shaft 43 freely. The short roller assembly 54 comprises a short roller shaft and a roller 42, the first end of the short roller shaft is fixed to a roller shaft bracket 13 and a roller 42 is mounted on the second end of the roller shaft 43 and capable to spin on the short roller shaft freely.

The fixed portion of the sliding means comprises a pair of U-shape channels 41. The U-shape channel 41 is a long U-shape flat channel to provide a flat straight run way track for rollers 42 to travel on. The pair of U-shape channels 41 are fixed on the side of the fixed-seat 11 facing the top-seat 12, positioned in parallel and square to the other U-shape channel 41 and on equal distance from the center line of the fixed-seat 11. The first end of the U-shape channel 41 is pointing to the front end 15 and the second end of the U-shape channel 41 is pointing to the rear end 16. The open side of the U-channel 22 is facing the center line of the fixed-seat 11. Both ends of the channel are closed as the roller travel limits, one of the travel limits 44 is removable and can be re-installed after the rollers 42 are inserted into the U-shape channel 41. The first end of the roller shaft brackets 13 are fixed on the top-seat 12 facing the fixed-seat 11 side, aligned in two lines and in parallel to the U-shape channels 41 on the fixed-seat 11. Inserting the rollers 42 of the roller assemblies into U-channels 22 of the U-shape channels 41 to connects the slidable portion and fixed portion of the sliding means and completes the assembly of the slidable seat. The top-seat 12 is fixed on the roller shaft brackets 13 and the fixed-seat 11 is fixed on the U-shape channel 41.

Figure 9:
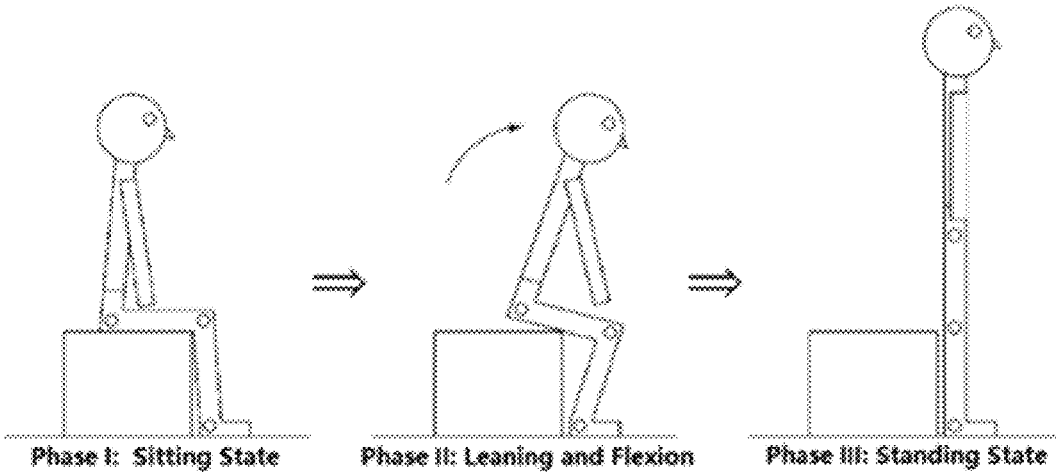
FIG. 9 illustrates the three phases on sit-to-stand transfer movements.
Figure 10:
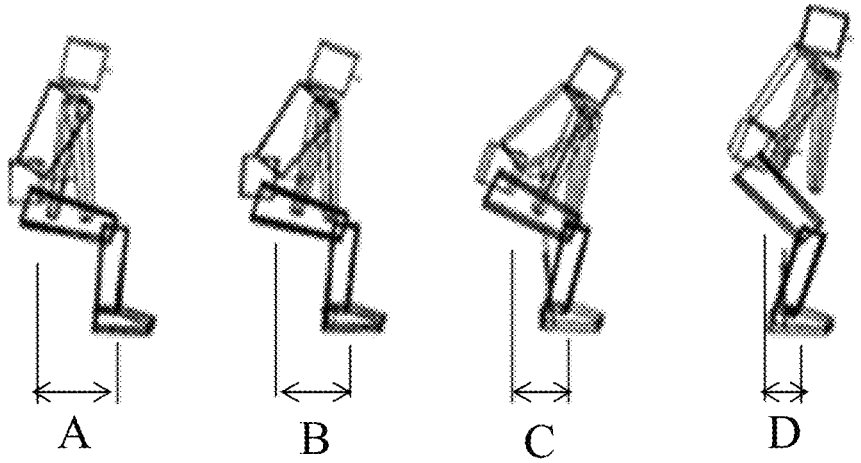
FIG. 10 illustrates the suspending weight torque changes according to the amount of trunk leaning and knee bending. Length is defined as a horizontal distance between the sitting trunk and the standing foot. Length A represents normal sitting. Length B represents slightly lean forward trunk. Length C represents fully lean forward trunk. Length D represents standing up.

On the first phase of sit-to-stand transfer movements, FIGS. 9 and 10, the individual starts the movements with leaning forward and flexion knees while slipping feet backward to reduce the suspending weight torque on a regular chair or seats. Sitting on the slidable seat 10, the individual can start the sit-to-stand transfer movements with leaning forward, flexion knees while keeping his feet fixed on the floor, and sliding forward trunk by pulling forward the top-seat 12 on the slidable seat 10 to minimize the suspending weight torque. Comparing to most of the chairs with limited room for slipping feet backward to reduce the suspending weight torque on standing up, the slidable seat 10 improves the performance on the suspending torque reduction noticeably and makes standing up an easy job for elderly and physically impaired individuals. With sliding forward the top-seat 12 on the slidable seat 10, the individual uses a small amount of muscle power to reduce the suspending weight torque on the first phase of the sit-to-stand transfer movements. In return, the gain in the suspending torque reduction requires less muscle power to stand up. In addition, the muscle used in the first phase of the sit-to-stand transfer movements is a different muscle used in the second phase of the sit-to-stand transfer movements and on different time frame. The muscle used in reducing suspending torque does negative to the muscle to be used on lifting trunk up. The disclosed method is to slide sitting trunk forward to reduce the suspending weight torque before activate muscle to stand up is a superior method and apparatus in efficiency using the muscle power on standing up movements.

Figure 3:
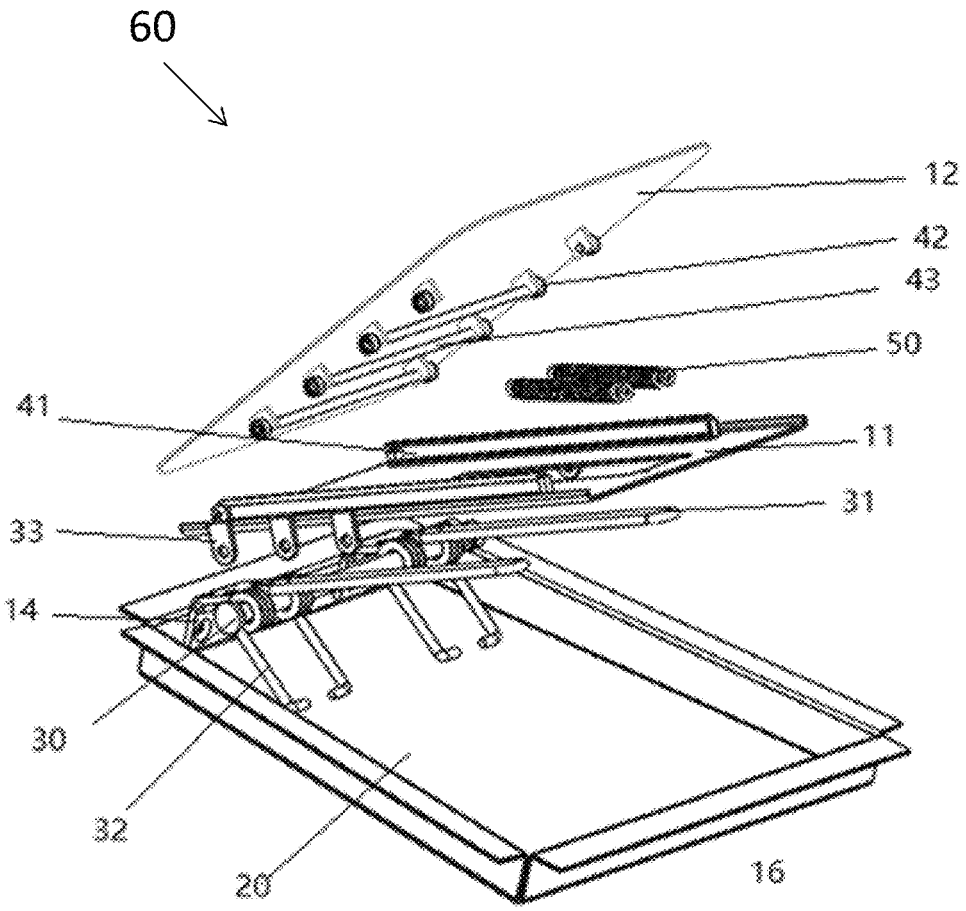
FIG. 3 is the explosive view of a slidable lifting seat in accordance to the embodiment of the present disclosure, the roller shaft is fixed in the roller shaft bracket on the top-seat.
Figure 7:
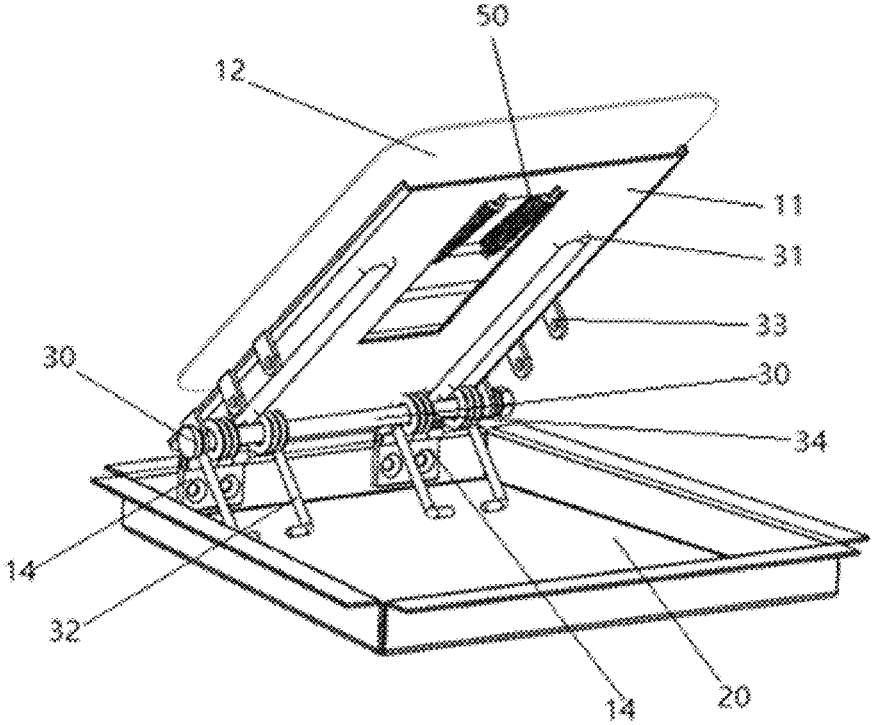
FIG. 7 illustrates the coil spring and hinge according to the embodiment of the present disclosure.

In addition, as shown in FIG. 3 and FIG. 7, the disclosed slidable lifting seat 60 apparatus comprises a slidable seat 10, a seat base 20, at least one coil spring 34, and a spring shaft 30. The slidable seat 10 is pivotally connected to a seat base 20 on the hinge 14 in the front end 15 of the fixed-seat 11. The first part of the hinge 14 is fixed on the fixed-seat 11 facing the seat base 20 side, the second part of the hinge is fixed on the seat base 20. The coil spring 34 is positioned near the front end 15 between the fixed-seat 11 and seat base 20. The top spring arm 31 is pressed against the fixed-seat 11 from the side of facing the seat base 20 and the spring arm is pointing to the rear 16 end, the bottom spring arm 32 is pressed to the seat base 20 from the side of facing the fixed-seat 11. The spring shaft 30 goes through the coil center of the coil spring 34 to loosely limit the movement of the coil spring 34, both ends of the spring shaft 30 are fixed to the spring bracket 33 on the fixed-seat 11 facing the seat base 20 side.

The slidable lifting seat 60 is raised and opened when the seat is not occupied and the coil spring 34 is expanded and relaxed. The slidable lifting seat 60 is down and closed when the seat is occupied and the coil spring 34 is compressed and loaded. On the first phase of the sit-to-stand transfer movements, the individual leans forward, bends knees, and shifts forward body weight by pulling forward the top-seat 12 on the slidable seat 10. As the top-seat 12 carrying the body weight moving forward, the body weight torque on the coil spring 34 under the fixed-seat 11 of the slidable seat 10 is reducing according to the amount of the forward travel distance. The lifting thrust from the slidable lifting seat 60 and the second phase of the sit-to-stand transfer movements will be triggered when the compressed spring torque becomes greater than the body weight torque. As the pre-loaded coil spring 34 expanded, the expanding spring force pushes the buttocks up and assists the individual standing up from sitting. The saved muscle power can be used to stabilize and balance the rising body on the third phase of the sit-to-stand transfer motion and reduce the risk of falling for elderly and physically impaired individuals. The disclosed method is to slide sitting trunk forward to reduce the body weight torque to trigger the pre-loaded spring expanding torque pushing sitting trunk up to.

What is claimed is:

1. A slidable seat apparatus to reduce the muscle force required for an individual standing up from a chair, a toilet seat, a commode, a wheel chair, a rollator seat or a walker seat, said apparatus comprises:

a base;

top seat to carry buttocks;

said top seat having a roller shaft disposed on a bottom side of the top seat;

a fixed seat disposed between the top seat and the base, and the fixed seat is slidably connected to the top seat and pivotably connected to the base;

said fixed seat having a window;

a re-track spring disposed within the window at rest and wherein a first end of said re-track spring is directly fixed on said roller shaft and a second end of said re-track spring is directly fixed on said fixed seat;

wherein upon sliding of said top seat over said base linearly toward the direction of the front end of the base, the re-track spring builds up energy; and wherein the re-track spring biases said top seat in the direction of the rear end of the base.

2. The apparatus as recited in claim 1 further comprising:

at least one roller assembly and multiple roller shaft brackets;

said roller assembly comprises said roller shaft and two rollers;

said rollers are mounted on either end of said roller shaft and are capable to spin on said roller shaft freely;

a pair of said roller shaft brackets are mounted on said roller shaft and fixedly suspended from a bottom side of the top seat to support the roller shaft and rollers;

a pair of U-shape channels to receive said rollers;

said U-shape channels are fixed on a top side of said fixed seat facing said top seat, positioned in parallel to each other.

3. The slidable lifting seat apparatus as recited in claim 1 further comprising:

a lifting spring positioned between said base and said fixed seat to reserve energy upon said base in a pivoted closed position.

4. The apparatus as recited in claim 3 wherein said fixed seat comprises at least one roller assembly and multiple roller shaft brackets;

said at least one roller assembly comprises said roller shaft and two rollers;

said rollers are mounted on either end of said roller shaft and capable to spin on said roller shaft freely;

a pair of said roller shaft brackets are mounted on said roller shaft and fixedly suspended from a bottom side of the top seat to support the roller shaft and rollers;

further comprising a pair of U-shape channels fixedly disposed on a top side of the fixed seat to receive said rollers.

* * * * *